US006457203B1

(12) United States Patent
Williams et al.

(10) Patent No.: US 6,457,203 B1
(45) Date of Patent: Oct. 1, 2002

(54) BUCKET INSERT AND WASH BUCKET

(75) Inventors: Todd A. Williams, Laguna Niguel; Richard A. Williams, La Quinta, both of CA (US)

(73) Assignee: Johnson Diversey, Inc., Sturtevant, WI (US)

( * ) Notice: Subject to any disclaimer, the term of this patent is extended or adjusted under 35 U.S.C. 154(b) by 0 days.

(21) Appl. No.: 09/574,948

(22) Filed: May 19, 2000

Related U.S. Application Data

(63) Continuation-in-part of application No. 09/443,076, filed on Nov. 18, 1999, now abandoned, which is a division of application No. 08/958,903, filed on Oct. 28, 1997, now Pat. No. 6,006,397, which is a continuation-in-part of application No. 08/865,520, filed on May 29, 1997, now Pat. No. 5,983,441.

(51) Int. Cl.[7] ..... A47L 13/58; B65D 25/00

(52) U.S. Cl. ..... 15/261; 15/260; 15/264; 206/514; 220/23.87

(58) Field of Search ..... 15/260, 261, 262, 15/263, 264; 206/514; 220/23.87, 731, 736, 771

(56) References Cited

U.S. PATENT DOCUMENTS

| | | | |
|---|---|---|---|
| 884,870 A | 4/1908 | Sikes | |
| 1,246,956 A | 11/1917 | Lerch | |
| 2,314,835 A | 3/1943 | Johns | |
| 3,562,841 A | 2/1971 | Royalty | |
| 4,798,307 A | 1/1989 | Evrard | |
| 5,456,357 A | 10/1995 | Wenner | |
| 5,548,865 A | 8/1996 | Pagani | |
| 5,687,873 A | 11/1997 | Jones | |
| 5,813,567 A | 9/1998 | Mangano | |

FOREIGN PATENT DOCUMENTS

| | | | |
|---|---|---|---|
| CA | 2049386 | 11/1992 | |
| EP | 0254507 | * 1/1988 | ..... 15/264 |
| FR | 2405692 | 6/1979 | |
| WO | 9221276 | 12/1992 | |

* cited by examiner

*Primary Examiner*—Randall E. Chin
(74) *Attorney, Agent, or Firm*—Neil E. Hamilton; Warren R. Bovee; Renee J. Rymarz

(57) ABSTRACT

An insert has an upper and lower portions used in conjunction with a variety of sizes of a wash buckets and a wringer to eliminate the contamination of clean wash solution with dirty solution during the moping process. The insert allows for a separation of liquids while limiting the volume that is lost in the wash bucket with the use of an insert. A wringer attaches to the insert and when used to wring out a mop the insert collects all the dirty solution that is extracted from the mop. The insert allows for the maximum clean wash solution volume and dirty solution volume while also increasing the height of the wringer when used in conjunction with the insert and wash bucket.

10 Claims, 6 Drawing Sheets

BUCKET INSERT AND WASH BUCKET

CROSS-REFERENCE TO RELATED APPLICATION

This is a continuation-in-part of Ser. No. 09/443,076 filed Nov. 18, 1999, now abandoned which is a divisional of Ser. No. 08/958,903 filed Oct. 28, 1997, U.S. Pat. No. 6,006,397 which is a continuation-in-part of Ser. No. 08/865,520 filed May 29, 1997, U.S. Pat. No. 5,983,441.

STATEMENT REGARDING FEDERALLY SPONSORED RESEARCH OR DEVELOPMENT

NONE

BACKGROUND OF THE INVENTION

The present invention relates to a bucket insert. More particularly, it relates to a bucket insert which has a lower portion with a smaller volume and an upper portion with a larger volume. The present invention also relates to a bucket insert which receives a wringer for floor cleaning and keeps clean wash liquid separate from dirty liquid.

In a floor cleaning process, a mop and a mop bucket are usually involved. A wringer is typically mounted to a mop bucket to wring the liquid from a wetted mop. During a cleaning process, the mop is dipped into a washing liquid contained in a bucket and is moved around the floor to remove dirt from the floor. In order for it to clean, the mop needs to be wrung repeatedly with the wringer and wetted by dipping it into the washing liquid. The dirty liquid squeezed from the mop in other systems was returned to the clean washing liquid. Thus, the washing liquid in the bucket is contaminated quickly.

Devices have been developed to overcome this disadvantage. U.S. Pat. No. 5,548,865 discloses a device for collecting dirty washing liquid and for containing clean liquid for wetting a floor-cloth for washing floors. The device includes a main container which supports a wringer and defines a compartment for collecting the liquid produced by wringing the floor cloth, and a secondary container or insert which is mounted to the top portion within the main container and contains clean washing liquid for wetting the floor cloth. Thus, the clean washing liquid is separated from the dirty liquid contained in the main container.

Although this device provides the advantage of separating the dirty fluid from the washing fluid, it suffers several drawbacks. First, because of the way the device is configured, the insert can only be fitted into certain buckets specially designed to receive the insert. Secondly, because the insert is mounted to the top portion of the bucket and is used to contain the clean washing liquid, the whole system is not very stable when first starting the cleaning as the washing liquid contained by the insert tends to raise and off-center the center of mass. Another problem is that there is no room for keeping the mop because the insert is not deep enough and it is not desirable to keep the mop in the dirty liquid of the main container.

U.S. Pat. No. 4,798,307 discloses a bucket having separate reservoirs for segregating clean washing liquid form dirty washing liquid. The bucket contains a discharge transfer compartment with holes on its bottom wall for wringing a mop and draining the dirty liquid into a discharge storage reservoir which is located beneath the discharge transfer compartment and occupies the whole lower portion of the bucket. The floors of the discharge transfer compartment and the clean liquid reservoir are shaped with adequate slope or curvature so that particulate material discharged from a mop is caused to move to the lowest point for removal. However, this bucket does not use a removable insert. Instead, a discharge transfer compartment and a discharge storage reservoir are used. Because they are mounted nonremovably and contain holes and curvatures, it is not convenient to clean the bucket.

U.S. Pat. No. 3,562,841 discloses a bucket provided with a squeeze plate for squeezing a mop of the sponge-type material. The bucket has an inner bucket for containing clean washing liquid and a separate container for receiving a filter and the dirty liquid drained through the filter. The separate container or insert has a fixed size and shape determined by the dimensions of the filter and the squeeze plate (wringer), therefore, can not be used for other types of buckets and mops.

U.S. Pat. Nos. 5,983,441 and 6,006,397 disclose a pliable mop bucket insert that is pushed against the side walls of the bucket. The insert is removably attached to the bucket and used to collect the dirty liquid while the bucket contains the clean liquid. The entire insert is placed in the bucket thereby reducing the volume of liquid that can be used in the bucket and requiring the user to refill the bucket more frequently.

Therefore, there is a need for a bucket insert and wringer, which separates dirty wash liquid from clean wash liquid and overcomes the disadvantages exist in the wash buckets and inserts as discussed above. Furthermore, there is a need for a bucket insert that reduces the time and effort needed to complete a job.

The objects of the invention therefore are:

a. Providing an improved insert for a wash bucket.

b. Providing an insert of the forgoing kind which has a larger capacity than those previously employed.

c. Providing an insert of the forgoing kind which displaces a minimum amount of space when placed in a bucket.

d. Provide an insert of the forgoing kind which affords ease of mopping.

e. Providing an insert of the forgoing kind which can fit into buckets of various sizes and accommodate wringers of various shapes.

SUMMARY OF THE INVENTION

The foregoing objects are accomplished and the shortcomings of the prior devices are over come by the invention which in one aspect provides a bucket insert having a container body with a lower and an upper portion, the upper portion having a larger volume than the lower portion. The lower portion of the bucket insert is adapted to be inserted into a bucket and the upper portion is arranged to extend laterally over the lower portion and to receive a wringer device. This arrangement allows for the insert to retain a larger volume while still not greatly reducing the volume of the wash bucket. The bucket insert includes a hook member that is operatively connected to the container body for connection to the bucket.

In another aspect, the hook member is connected to the upper portion and extends over the lower portion of the insert.

In one embodiment, the lower and upper portions have a front wall, a back wall, two side walls and with respect to the lower portion has a bottom wall.

In another embodiment, the walls of the upper and lower portion are connected by shoulder sections.

In still another aspect, the invention provides a mopping apparatus for collecting dirty wash liquid. The apparatus includes a bucket for containing clean washing liquid. The lower portion of the previously described insert is placed in the bucket with the upper portion extending above the bucket. A wringer is supported on the upper portion of the insert.

These and still other objects and advantages of the invention will be apparent from the description that follows. In the detailed description below preferred embodiments of the invention are described in reference to the full scope of the invention. Rather the invention may be employed in other embodiments.

DETAILED DESCRIPTION OF THE PREFERRED EMBODIMENT

Figure 1:
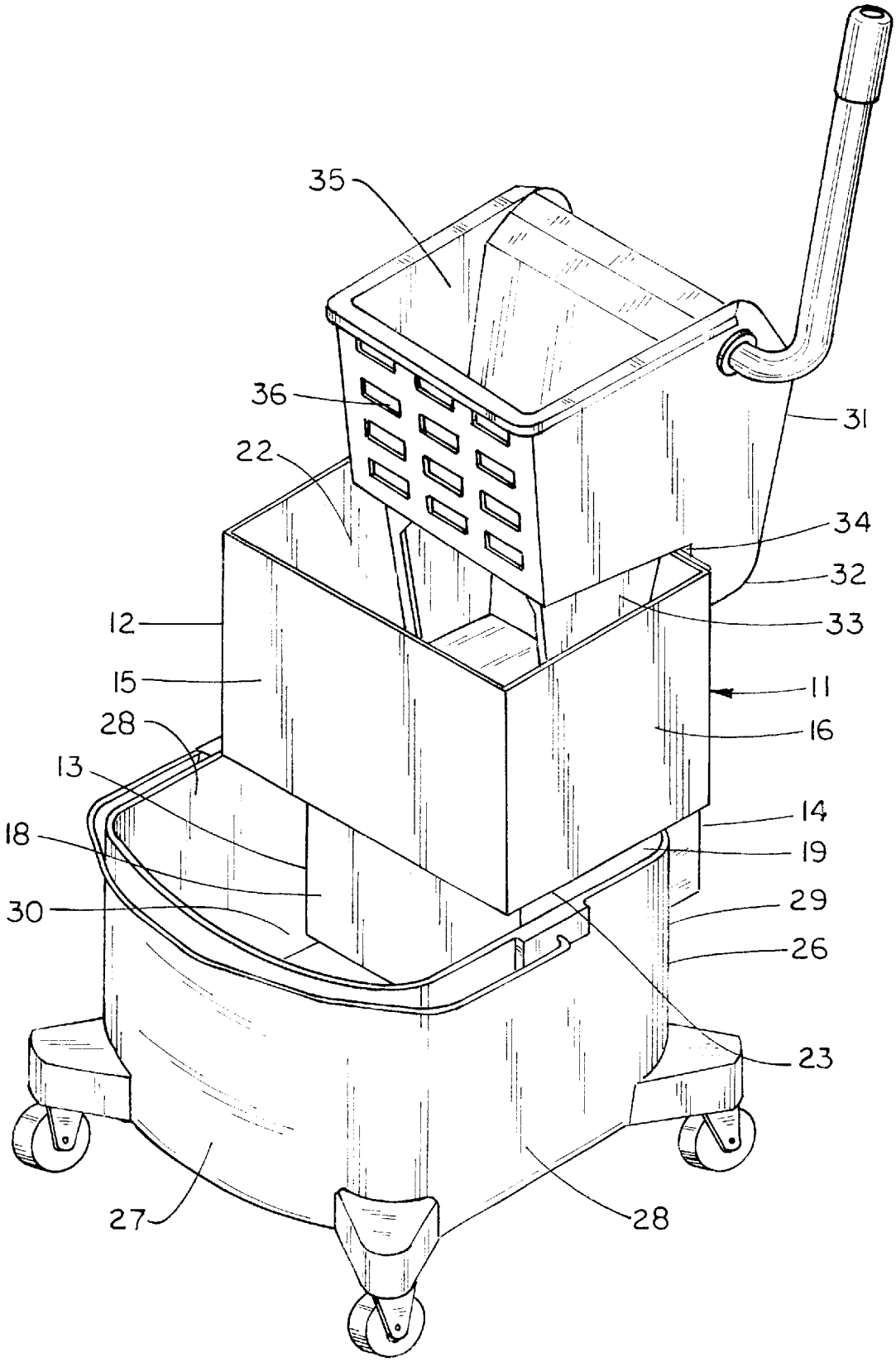
FIG. 1 is a perspective view of the insert of this invention engaged with a bucket and a wringer.
Figure 2:
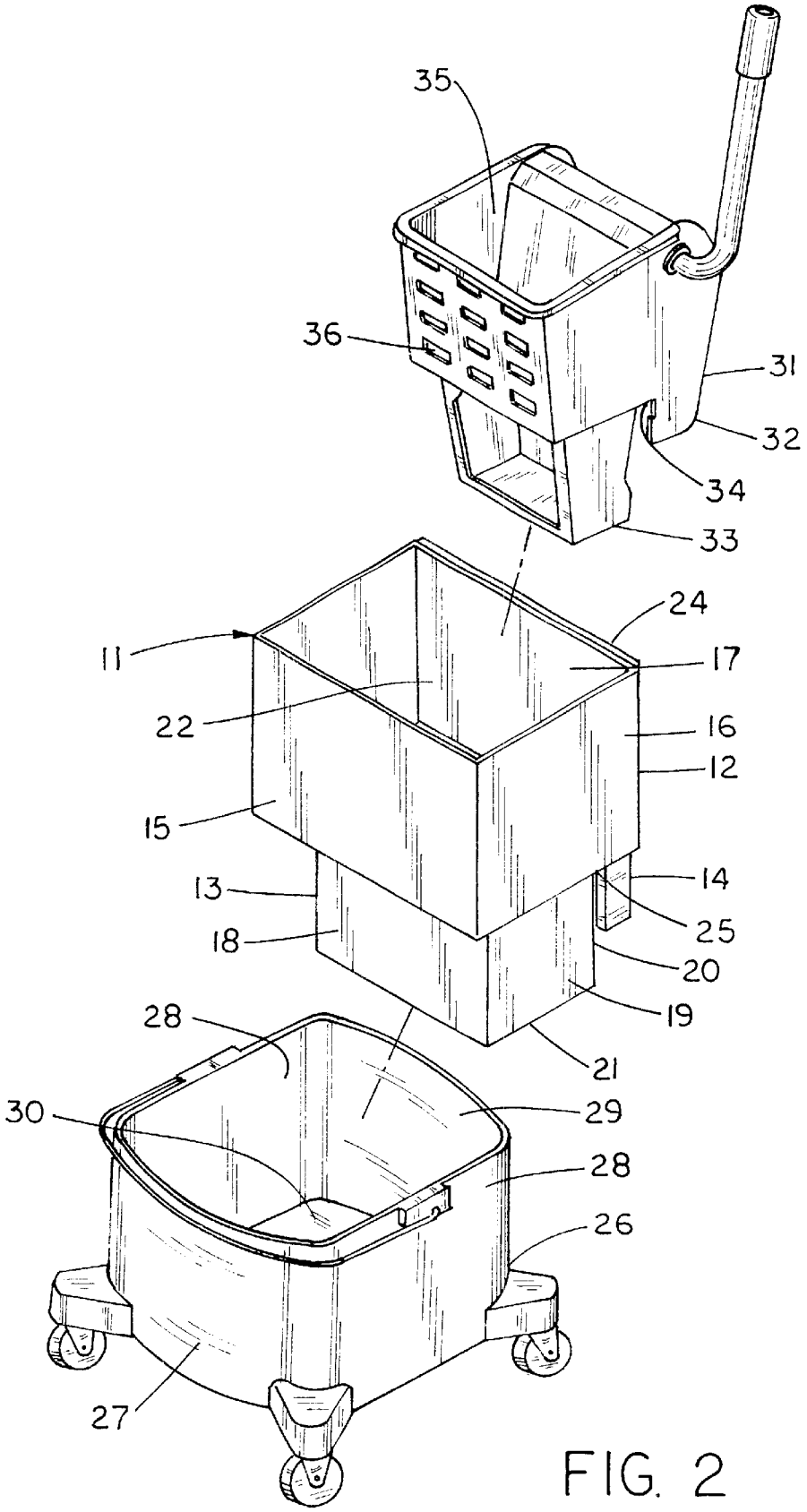
FIG. 2 is an exploded view of the insert with the bucket and wringer.

Referring to FIGS. 1 and 2, the insert generally 11 is shown in conjunction with a mop bucket 26 and a wringer 31. Bucket 26 has the usual side walls 28, a front wall 27 and a back wall 29 defining a space 30 for containing washing liquid and receiving the lower portion 13 of the insert 11. Wringer 31 has a basket 35 for receiving and wringing dirty water from a mop through small openings 36. The wringer 31 is connected to insert 11 by a support hook 32 with back wall 17 and reinforcement section 24 placed in the gap 34 formed between the lower portion 33 of the wringer 31 and the support hook 32.

As seen in FIGS. 3–6, the insert 11 has an upper portion 12 and a lower portion 13. The upper portion 12 has a front wall 15, a back wall 17 and side walls 16. The lower portion 13 also has a front wall 18, a back wall 20, side walls 19, and a bottom 21. The walls of the insert 11 define a space or opening 22. On the back wall 17 of the upper portion 12 of the insert 11 there are one or more hooks 14, the preferred means of attaching the insert 11 to the bucket 26. The back wall 20 of the lower portion 13 is angled toward the front wall 18 in the insert as shown at 37.

Figure 6:
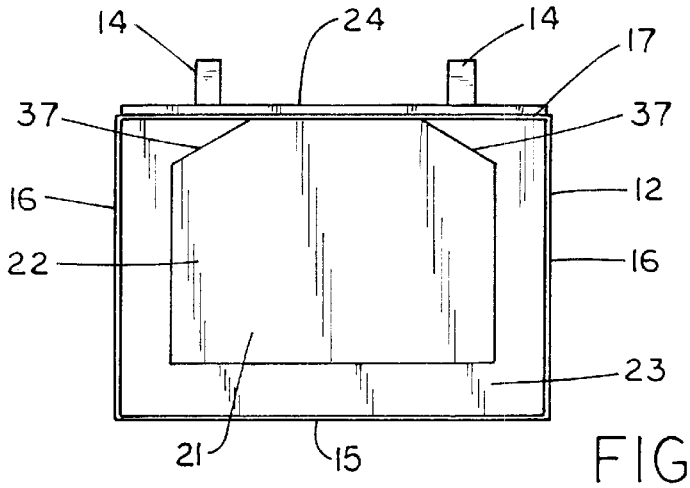
FIG. 6 is a top view of the insert.
Figure 7:
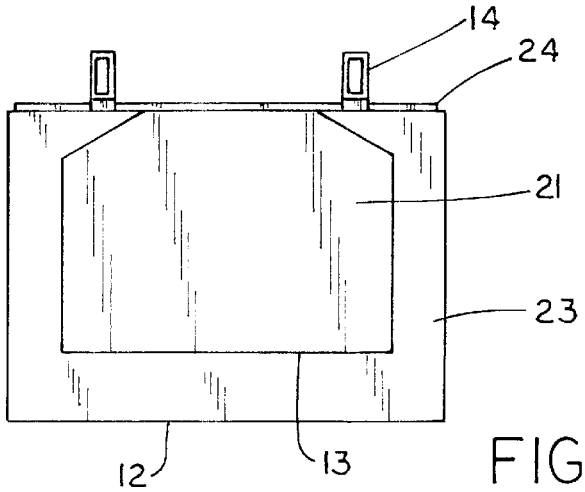
FIG. 7 is a bottom view of the insert.
Figure 8:
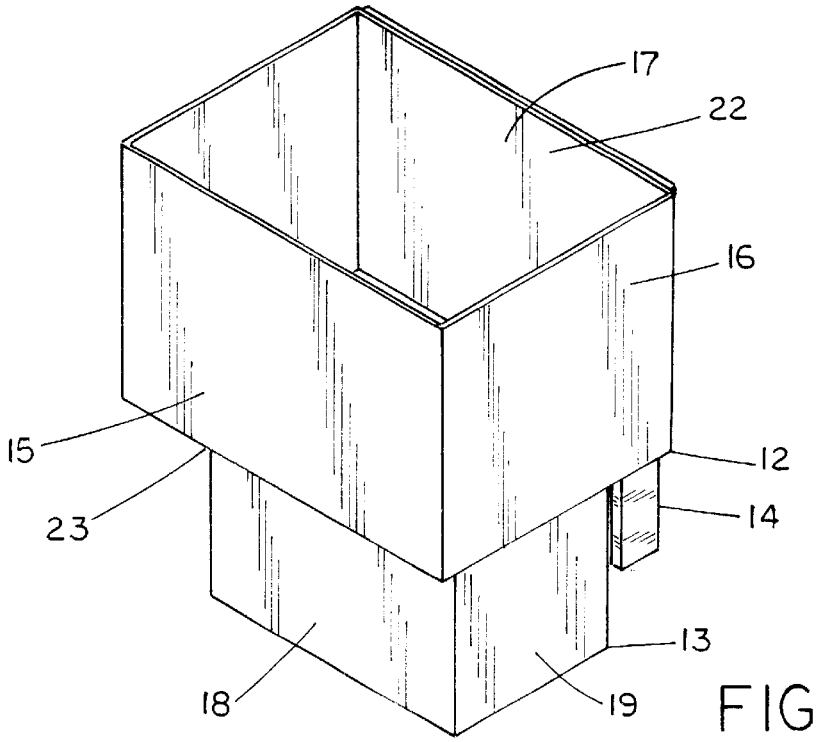
FIG. 8 is a front perspective view of the insert.
Figure 9:
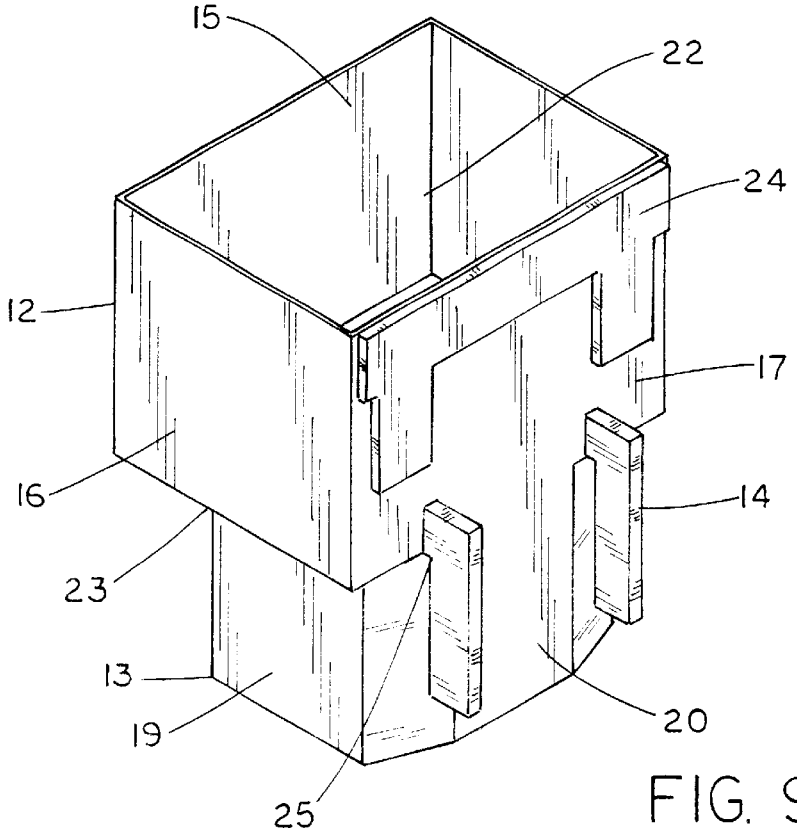
FIG. 9 is a back perspective view of the insert.

As shown in FIGS. 6 and 7, the upper portion 12 of the insert 11 is larger in volume and dimension than the lower portion 13, the two portions being joined by the shoulder section 23. Compare the relative size as seen in FIGS. 8 and 9 in conjunction with FIG. 6.

Figure 4:
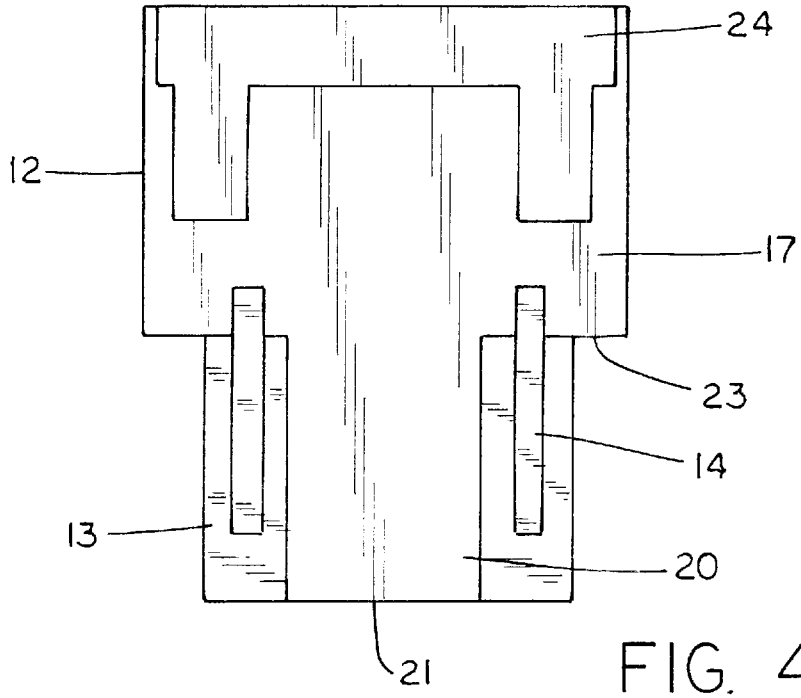
FIG. 4 is a back view of the insert.
Figure 5:
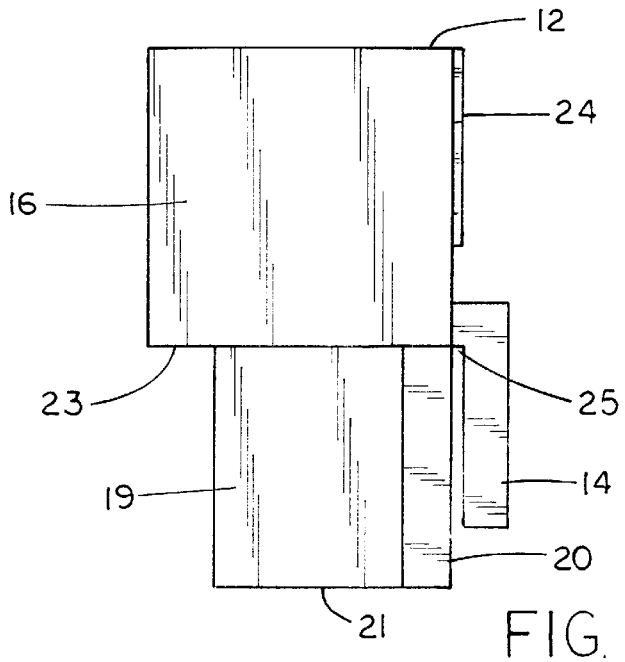
FIG. 5 is a side view of the insert.

As indicated in FIG. 2, insert 11 is installed into bucket 26 in such a way that the back wall 20 of lower portion 13 of the insert 11 is placed against back wall 29 with the side walls 19 close or in touch with the side walls 28 of the bucket 26. Hook 14 is used to keep the insert 11 in a predetermined position, this is accomplished by setting the gap 25 between the hook member 14 and the back wall 20 at a certain level as shown in FIG. 5. As shown in FIG. 4, insert 11 has the hook 14 connected to the back wall 17 of upper portion 12 engaging with the upper edge of the bucket 26 and supporting the insert 11 above the bucket 26. Once insert 11 is placed in a predetermined position inside bucket 26, wringer 31 can be installed in insert 11.

The upper portion 12 of insert 11 is placed substantially above the bucket 26 so that the insert 11 does not occupy excessive space inside the bucket 26. The lower portion 13 of insert 11 has a dimension smaller than the upper opening 22 of the bucket 26, so that the lower portion 13 can be placed into the bucket 26, as shown in FIG. 2.

The lower portion 13 and the upper portion 12 have different dimensions. The upper portion 12 is larger in volume than the lower portion 13 of the insert 11 with the ratio being approximately 2:1. Preferably the upper portion has a volume of 482.75 fluid ounces and the lower portion has the volume of 231 fluid ounces. The use of the upper portion 12 and a lower portion 13 in the insert 11 allows the volume of the insert 11 to be increased while still allowing the volume of the wash bucket 26 to remain at a level to be practical for use. The upper portion 12 preferably has a height of 8.2 inches, a length of 12 inches and a depth of 9 inches. The lower portion 13 preferably has a height of 7 inches, a length of 9 inches and a depth of 7 inches. In order to save space in the bucket 26, the lower portion 13 should be as small as possible, as long as the insert 11 can be held steadily in position.

Figure 3:
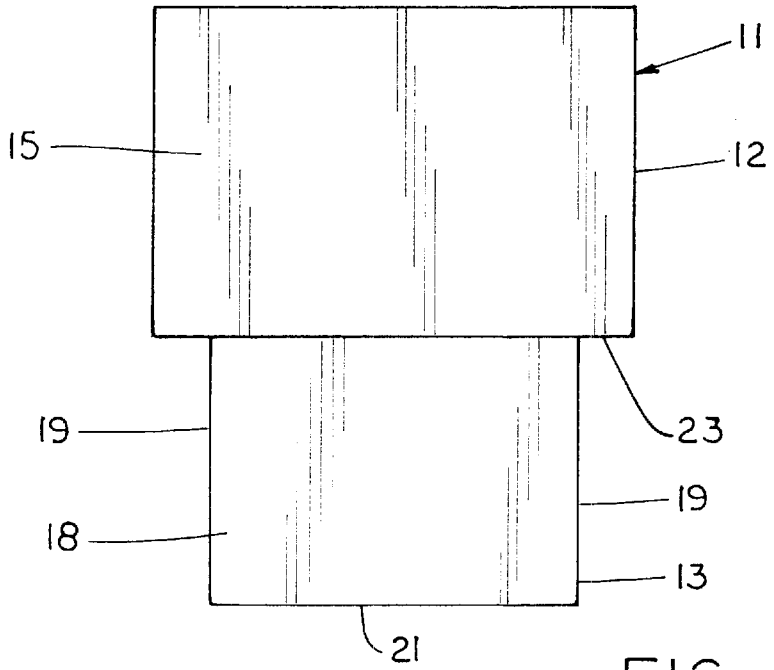
FIG. 3 is a front view of the insert.

As shown in FIGS. 3, 6 and 7, a shoulder section 23 is formed between the side walls 19 and the front wall 18 of the lower portion 13 and the side walls 16 and the front wall 15 of the upper portion 12. Referring to FIG. 1, the shoulder section is positioned above an upper edge of the bucket 26 which prevents the upper portion 12 from coming into contact with the washing solution in the bucket 26 thereby, not reducing the volume of wash liquid the bucket 26 contains.

Figure 10:
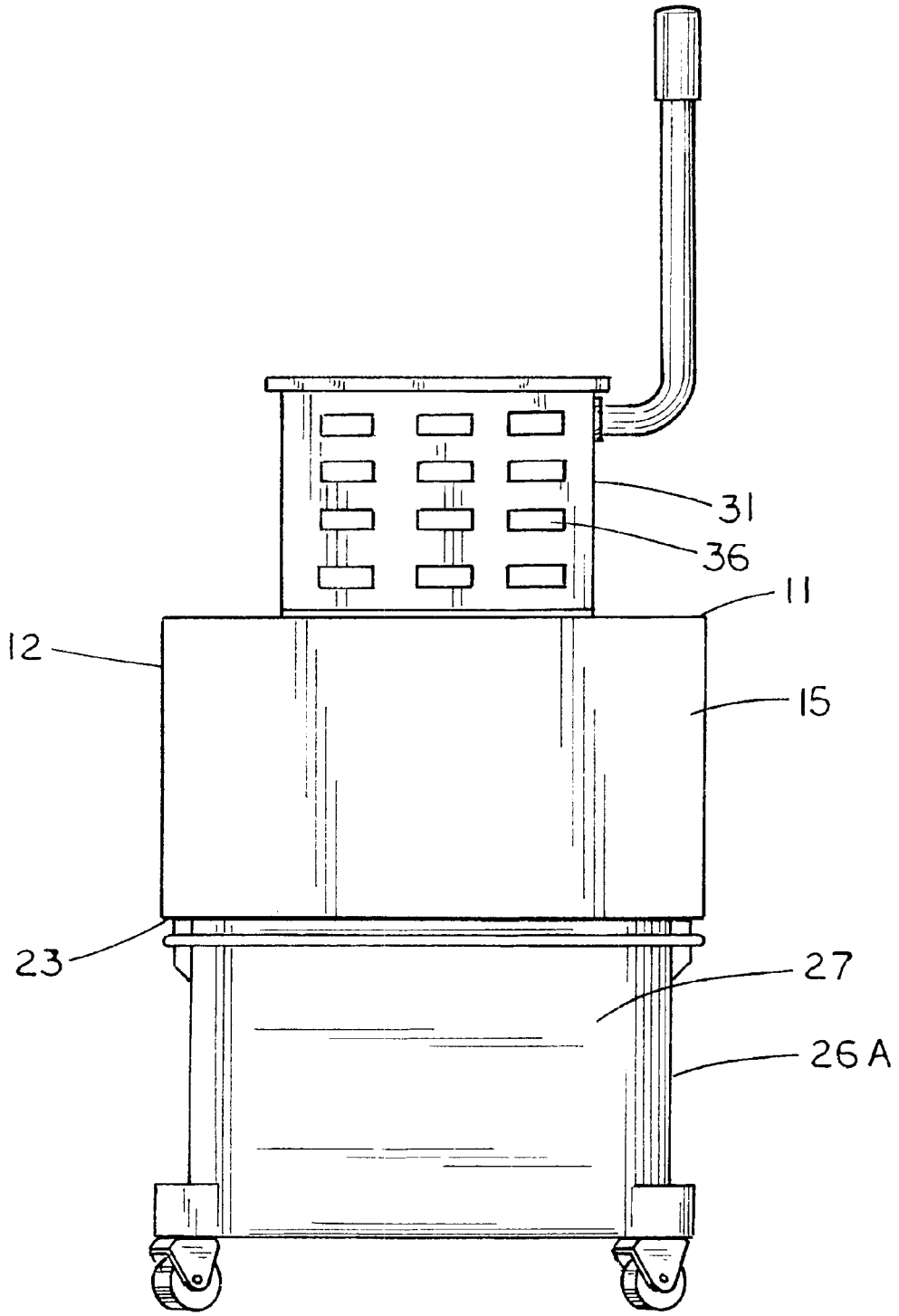
FIG. 10 is a front view of an alternative embodiment.

An alternative embodiment as shown in FIG. 10 depicts the insert 11 used with a smaller size bucket 26A. This embodiment shows the shoulder section 23 and the upper portion 12 above and extending laterally over the upper edge of the bucket 26A. With the upper portion 12 of the insert 11 is placed above the bucket 26A, the shoulder section 23 may sit on the upper edge of the bucket 26A. The wringer 31 is placed on the insert 11 so that the openings 36 are inside the insert 11 allowing dirty solution to be extracted from a mop into the insert 11. FIG. 10 shows how the insert 11 is adaptable to fit different size buckets 26A while still maintaining the wash liquid volume levels adequate for mopping.

The insert 11 of the present invention is preferably made of synthetic materials such as a rigid plastic. The insert 11 should have sufficient strength to hold its basic shape with dirty washing liquid and also it should remain stable inside the bucket 26. Insert 11 is preferably rigid and sturdy enough to support a wringer 31 by itself. The insert 11 can also be made with certain reinforced portions for receiving and supporting wringer 31. As shown in FIGS. 4 and 9 the added reinforcement can be achieved by having a reinforcement section 24 on the back wall 17 of the upper portion 12 of the insert 11 where it is engaged with the wringer 31.

The important features of the insert 11 are as follows: The lower portion 13 of the insert 11 takes up less volume in the bucket 26, so the bucket 26 has more space for cleaning fluid and it is easier to place a mop in the clean water of the bucket 26. The arrangement of the upper portion 12 of the insert 11 above the bucket 26, allows the height of the wringer 31 to be increased. Thus, for a person of normal height, the back strain will be reduced when the person operates the wringer 31. Another feature of the insert 11 is that it is possible for the insert 11 to fit a large variety of sizes of existing bucket-wringer systems because insert 11 has a smaller lower portion 13 and a larger upper portion 12. The lower portion 13 has a smaller dimension and can fit in most size buckets 26 while the upper portion 12 is above the bucket 26. The upper portion 12 of the insert 11 allows the lower portion 13 to be of any practical size dictated only by stability considerations. Still another feature of the insert 11 is that the insert 11 is stabilized by the weight of the wringer 31, so that even if the bucket 26 is full of clean washing liquid the insert 11 will not float in the bucket 26.

A cleaning operation according to the present invention usually comprises the following steps a) filling bucket 26 with washing liquid which usually is water with dissolved detergent; b) installing insert 11 into bucket 26 with the shoulder section 23 placed on or near the bucket sides 28; c) installing wringer 31 to insert 11 by slip-fitting gap 34 of wringer 31 to the upper portion 12 of insert 11 with the hook 32; d) dipping a mop into the clean washing liquid contained in the bucket 26; e) moving the dipped mop over a surface to be cleaned; f) inserting the dirty mop into the wringer 31 and wringing it allowing dirty liquid to drain through openings 36 of the wringer basket 35 into the insert 11 where it accumulates in the lower portion 13 first; g) then repeat steps d) to f) until the surface is clean.

Based on the above description of the present invention, it is clear that various modifications can be made without departing from the spirit and the scope of the invention. Obviously, different numbers and types of hook members 14 can be used to position insert 11 above the bucket 26 in conjunction with the lower portion 13 which can be of varying dimensions providing the stability of the insert 11 is not compromised. The reinforcement section 24 can be eliminated by using a more sturdy material to construct the insert 11 or by rolling the top edges of the insert 11. This would allow the wringer 31 to have the stability it needs. The variation in the ratio and volumes of the upper portion 12 and the lower portion 13 can be adjusted so that the insert 11 maintains its stability when engaged with the wash bucket 26 but the lower portion 13 takes up even less room in the wash bucket 26. Further, while the particular heights have been indicated for the insert 11 and more importantly, the height for the upper portion 12, an increase in the height would allow an increase in the height of the total system which in turn would make the location of the wringer 31 even higher allowing a tall individual to use the system with more easy. All such and other modifications within the spirit of the invention are meant to be within its scope as defined by the appended claims.

What is claimed is:

1. A bucket insert for a bucket of different geometric configurations for collecting dirty washing liquid comprising:

a container body having a lower portion and an upper portion, the upper portion having a larger volume than the lower portion, the lower portion adapted to be inserted into a bucket, the upper portion and lower portion connected by a step portion defined by at least two shoulder sections, the container body constructed and arranged to extend laterally over the bucket, to receive a wringer device and a hook member operatively connected to the container body for connection to the bucket.

2. The bucket insert as defined in claim 1, wherein the hook member is at least one hook member connected to the upper portion and extends over the lower portion of the container body.

3. The bucket insert as defined in claim 1, wherein the upper portion of the container body includes a front wall, two side walls and a back wall and the lower portion of the container body includes a front wall, two side walls, a back wall and a bottom wall.

4. The bucket insert as defined in claim 3, wherein the front and side walls of the upper and lower portions are connected by the shoulder sections, the shoulder sections adapted to be positioned above a top edge of the bucket.

5. The bucket insert as defined in claim 4, wherein the upper portion of the container body is adapted to support a wringer device.

6. A mopping apparatus for collecting dirty washing liquid comprising:

a bucket defining a space for containing clean washing liquid;

an insert including a container body having a lower portion and an upper portion, the upper portion having a larger volume than the lower portion, the lower portion is constructed and arranged to fit within the bucket and the upper portion is constructed and arranged to extend above the bucket;

one or more hook members operatively connected to the container body, the container body inserted into the bucket with the one or more hook members extending over a section of the bucket; and a wringer operatively supported on the upper portion.

7. The mopping apparatus as defined in claim 6, wherein the upper portion of the container body includes a front wall, two side walls and a back wall and the lower portion of the container body includes a front wall, two side walls, a back wall and a bottom wall.

8. The mopping apparatus as defined in claim 7, wherein the front and side walls of the upper and lower portions are connected by shoulder sections, the shoulder sections connecting the side walls of the upper portion and lower portion of the container body and adapted to be positioned above a top edge of the bucket.

9. The mopping apparatus as defined in claim 8, wherein the shoulder sections are positioned on an upper edge of the bucket.

10. The mopping apparatus as defined in claim 6, wherein the container body is composed of a rigid plastic material.

* * * * *